US006078306A

United States Patent [19]

Lewis

[11] Patent Number: 6,078,306

[45] Date of Patent: Jun. 20, 2000

[54] BASIC INPUT-OUTPUT SYSTEM (BIOS) READ-ONLY MEMORY (ROM) WITH CAPABILITY FOR VERTICAL SCROLLING OF BITMAPPED GRAPHIC TEXT BY COLUMNS

[75] Inventor: Timothy A. Lewis, Fremont, Calif.

[73] Assignee: Phoenix Technologies Ltd., San Jose, Calif.

[21] Appl. No.: 08/955,383

[22] Filed: Oct. 21, 1997

[51] Int. Cl.[7] ..... G09G 5/34

[52] U.S. Cl. ..... 345/123; 345/124; 345/125; 345/341

[58] Field of Search ..... 345/123–125, 345/162, 100, 973, 341; 340/157, 724, 726, 703

[56] References Cited

U.S. PATENT DOCUMENTS

| | | | |
|---|---|---|---|
| Re. 33,894 | 4/1992 | Bradley . | |
| 4,196,430 | 4/1980 | Denko | 340/726 |
| 4,437,093 | 3/1984 | Bradley | 340/726 |
| 4,506,343 | 3/1985 | Shipp, Jr. et al. | 364/900 |
| 4,873,514 | 10/1989 | Nakagawa et al. | 340/726 |
| 5,175,813 | 12/1992 | Golding et al. | 395/157 |
| 5,200,738 | 4/1993 | Fumoto et al. | 340/726 |
| 5,266,932 | 11/1993 | Tokumitsu | 345/123 |
| 5,317,306 | 5/1994 | Abraham et al. | 345/118 |
| 5,333,247 | 7/1994 | Gest et al. | 395/138 |
| 5,495,566 | 2/1996 | Kwatinetz | 395/157 |
| 5,754,161 | 5/1998 | Noguchi et al. | 345/123 |
| 5,771,032 | 6/1998 | Cline et al. | 345/127 |
| 5,877,760 | 3/1999 | Onda et al. | 345/341 |

FOREIGN PATENT DOCUMENTS

| | | |
|---|---|---|
| 0071725 | of 0000 | European Pat. Off. . |
| 0071744 | of 0000 | European Pat. Off. . |
| 0 159 851 | 10/1985 | European Pat. Off. . |
| 0 700 211 | 3/1996 | European Pat. Off. . |
| 4405329 | of 0000 | Germany . |
| 4405330 | of 0000 | Germany . |
| 91/07739 | 5/1991 | WIPO . |
| 92/20033 | 11/1992 | WIPO . |

*Primary Examiner*—Richard A. Hjerpe
*Assistant Examiner*—Henry N. Tran
*Attorney, Agent, or Firm*—Foley & Lardner

[57] ABSTRACT

Data representing bitmapped graphics and/or text characters is stored in a video buffer or memory of a computer. A window is designated that includes contiguous rows and columns of data to be scrolled. The data in the window is vertically scrolled by columns. One column can be scrolled at a time, or two or more adjacent or alternating columns can be scrolled at a time. The column scrolling method is faster than scrolling by rows when the number of rows in the window is small and/or the number of rows to scroll is high. Program instructions for implementing the scrolling are preferably stored in a Basic Input-Output System (BIOS) Read-Only Memory (ROM) chip to provide a built-in, backward compatible low resolution display capability, e.g. a Color Graphics Adapter (CGA) text display, for a newer computer or other data processing device.

9 Claims, 20 Drawing Sheets

FIG. 2a
(PRIOR ART)

THIS EXAMPLE SHOWS
SEVERAL LINES OF TEXT
BEING SCROLLED UP TO
MAKE ROOM FOR ANOTHER
LINE AT THE BOTTOM

FIG. 2b
(PRIOR ART)

SEVERAL LINES OF TEXT
SEVERAL LINES OF TEXT
BEING SCROLLED UP TO
MAKE ROOM FOR ANOTHER
LINE AT THE BOTTOM

FIG. 2c
(PRIOR ART)

SEVERAL LINES OF TEXT
BEING SCROLLED UP TO
BEING SCROLLED UP TO
MAKE ROOM FOR ANOTHER
LINE AT THE BOTTOM

FIG. 2d
(PRIOR ART)

SEVERAL LINES OF TEXT
BEING SCROLLED UP TO
MAKE ROOM FOR ANOTHER
MAKE ROOM FOR ANOTHER
LINE AT THE BOTTOM

FIG. 2e
(PRIOR ART)

SEVERAL LINES OF TEXT
BEING SCROLLED UP TO
MAKE ROOM FOR ANOTHER
LINE AT THE BOTTOM
LINE AT THE BOTTOM

FIG. 2f
(PRIOR ART)

SEVERAL LINES OF TEXT
BEING SCROLLED UP TO
MAKE ROOM FOR ANOTHER
LINE AT THE BOTTOM

FIG. 3a
(PRIOR ART)

THIS EXAMPLE SHOWS
SEVERAL LINES OF TEXT
BEING SCROLLED DOWN TO
MAKE ROOM FOR ANOTHER
LINE AT THE TOP

FIG. 3b
(PRIOR ART)

THIS EXAMPLE SHOWS
SEVERAL LINES OF TEXT
BEING SCROLLED DOWN TO
MAKE ROOM FOR ANOTHER
MAKE ROOM FOR ANOTHER

FIG. 3c
(PRIOR ART)

THIS EXAMPLE SHOWS
SEVERAL LINES OF TEXT
BEING SCROLLED DOWN TO
BEING SCROLLED DOWN TO
MAKE ROOM FOR ANOTHER

FIG. 3d
(PRIOR ART)

THIS EXAMPLE SHOWS
SEVERAL LINES OF TEXT
SEVERAL LINES OF TEXT
BEING SCROLLED DOWN TO
MAKE ROOM FOR ANOTHER

FIG. 3e
(PRIOR ART)

THIS EXAMPLE SHOWS
THIS EXAMPLE SHOWS
SEVERAL LINES OF TEXT
BEING SCROLLED DOWN TO
MAKE ROOM FOR ANOTHER

FIG. 3f
(PRIOR ART)

THIS EXAMPLE SHOWS
SEVERAL LINES OF TEXT
BEING SCROLLED DOWN TO
MAKE ROOM FOR ANOTHER

FIG. 4a

| | | | | | | | |
|---|---|---|---|---|---|---|---|
| | | | | | | | |
| A | B | C | | | | | |
| D | E | F | | | | | |
| | | | | | | | |

FIG. 4b

| | | | | | | | |
|---|---|---|---|---|---|---|---|
| A | | | | | | | |
| A | B | C | | | | | |
| D | E | F | | | | | |
| | | | | | | | |

FIG. 4c

| | | | | | | | |
|---|---|---|---|---|---|---|---|
| A | | | | | | | |
| D | B | C | | | | | |
| D | E | F | | | | | |
| | | | | | | | |

FIG. 4d

| | | | | | | | |
|---|---|---|---|---|---|---|---|
| A | B | | | | | | |
| D | B | C | | | | | |
| D | E | F | | | | | |
| | | | | | | | |

FIG. 4e

| | | | | | | | |
|---|---|---|---|---|---|---|---|
| A | B | | | | | | |
| D | E | C | | | | | |
| D | E | F | | | | | |
| | | | | | | | |

FIG. 4f

| | | | | | | | |
|---|---|---|---|---|---|---|---|
| A | B | C | | | | | |
| D | E | C | | | | | |
| D | E | F | | | | | |
| | | | | | | | |

FIG. 4g

| | | | | | | | |
|---|---|---|---|---|---|---|---|
| A | B | C | | | | | |
| D | E | F | | | | | |
| D | E | F | | | | | |
| | | | | | | | |

FIG. 4h

| | | | | | | | |
|---|---|---|---|---|---|---|---|
| A | B | C | | | | | |
| D | E | F | | | | | |
| | | | | | | | |
| | | | | | | | |

FIG. 5a

| | | | | | | | |
|---|---|---|---|---|---|---|---|
| | | | | | | | |
| | | | | | | | |
| A | B | C | | | | | |
| D | E | F | | | | | |

FIG. 5b

| | | | | | | | |
|---|---|---|---|---|---|---|---|
| A | | | | | | | |
| | | | | | | | |
| A | B | C | | | | | |
| D | E | F | | | | | |

FIG. 5c

| | | | | | | | |
|---|---|---|---|---|---|---|---|
| A | | | | | | | |
| D | | | | | | | |
| A | B | C | | | | | |
| D | E | F | | | | | |

FIG. 5d

| | | | | | | | |
|---|---|---|---|---|---|---|---|
| A | B | | | | | | |
| D | | | | | | | |
| A | B | C | | | | | |
| D | E | F | | | | | |

FIG. 5e

| | | | | | | | |
|---|---|---|---|---|---|---|---|
| A | B | | | | | | |
| D | E | | | | | | |
| A | B | C | | | | | |
| D | E | F | | | | | |

FIG. 5f

| | | | | | | | |
|---|---|---|---|---|---|---|---|
| A | B | C | | | | | |
| D | E | | | | | | |
| A | B | C | | | | | |
| D | E | F | | | | | |

FIG. 5g

| | | | | | | | |
|---|---|---|---|---|---|---|---|
| A | B | C | | | | | |
| D | E | F | | | | | |
| A | B | C | | | | | |
| D | E | F | | | | | |

FIG. 5h

| | | | | | | | |
|---|---|---|---|---|---|---|---|
| A | B | C | | | | | |
| D | E | F | | | | | |
| | | | | | | | |
| | | | | | | | |

FIG. 6a

| | | | | | | | |
|---|---|---|---|---|---|---|---|
| | | | | | | | |
| A | B | C | | | | | |
| D | E | F | | | | | |
| | | | | | | | |

FIG. 6b

| | | | | | | | |
|---|---|---|---|---|---|---|---|
| | | | | | | | |
| A | B | C | | | | | |
| D | E | F | | | | | |
| D | | | | | | | |

FIG. 6c

| | | | | | | | |
|---|---|---|---|---|---|---|---|
| | | | | | | | |
| A | B | C | | | | | |
| A | E | F | | | | | |
| D | | | | | | | |

FIG. 6d

| | | | | | | | |
|---|---|---|---|---|---|---|---|
| | | | | | | | |
| A | B | C | | | | | |
| A | E | F | | | | | |
| D | E | | | | | | |

FIG. 6e

| | | | | | | | |
|---|---|---|---|---|---|---|---|
| | | | | | | | |
| A | B | C | | | | | |
| A | B | F | | | | | |
| D | E | | | | | | |

FIG. 6f

| | | | | | | | |
|---|---|---|---|---|---|---|---|
| | | | | | | | |
| A | B | C | | | | | |
| A | B | F | | | | | |
| D | E | F | | | | | |

FIG. 6g

| | | | | | | | |
|---|---|---|---|---|---|---|---|
| | | | | | | | |
| A | B | C | | | | | |
| A | B | C | | | | | |
| D | E | F | | | | | |

FIG. 6h

| | | | | | | | |
|---|---|---|---|---|---|---|---|
| | | | | | | | |
| | | | | | | | |
| A | B | C | | | | | |
| D | E | F | | | | | |

FIG. 7a

| | | | | | | | |
|---|---|---|---|---|---|---|---|
| | | | | | | | |
| A | B | C | D | | | | |
| E | F | G | H | | | | |
| | | | | | | | |

FIG. 7b

| | | | | | | | |
|---|---|---|---|---|---|---|---|
| A | B | | | | | | |
| A | B | C | D | | | | |
| E | F | G | H | | | | |
| | | | | | | | |

FIG. 7c

| | | | | | | | |
|---|---|---|---|---|---|---|---|
| A | B | | | | | | |
| E | F | C | D | | | | |
| E | F | G | H | | | | |
| | | | | | | | |

FIG. 7d

| | | | | | | | |
|---|---|---|---|---|---|---|---|
| A | B | C | D | | | | |
| E | F | C | D | | | | |
| E | F | G | H | | | | |
| | | | | | | | |

FIG. 7e

| | | | | | | | |
|---|---|---|---|---|---|---|---|
| A | B | C | D | | | | |
| E | F | G | H | | | | |
| E | F | G | H | | | | |
| | | | | | | | |

FIG. 7f

| | | | | | | | |
|---|---|---|---|---|---|---|---|
| A | B | C | D | | | | |
| E | F | G | H | | | | |
| | | | | | | | |
| | | | | | | | |

FIG. 8a

| | | | | | | | |
|---|---|---|---|---|---|---|---|
| A | B | C | D | E | F | G | H |
| I | J | K | L | M | N | O | P |
| | | | | | | | |

FIG. 8b

| | | | | | | | |
|---|---|---|---|---|---|---|---|
| A | B | C | D | | | | |
| A | B | C | D | E | F | G | H |
| I | J | K | L | M | N | O | P |
| | | | | | | | |

FIG. 8c

| | | | | | | | |
|---|---|---|---|---|---|---|---|
| A | B | C | D | | | | |
| I | J | K | L | E | F | G | H |
| I | J | K | L | M | N | O | P |
| | | | | | | | |

FIG. 8d

| | | | | | | | |
|---|---|---|---|---|---|---|---|
| A | B | C | D | E | F | G | H |
| I | J | K | L | E | F | G | H |
| I | J | K | L | M | N | O | P |
| | | | | | | | |

FIG. 8e

| | | | | | | | |
|---|---|---|---|---|---|---|---|
| A | B | C | D | E | F | G | H |
| I | J | K | L | M | N | O | P |
| I | J | K | L | M | N | O | P |
| | | | | | | | |

FIG. 8f

| | | | | | | | |
|---|---|---|---|---|---|---|---|
| A | B | C | D | E | F | G | H |
| I | J | K | L | M | N | O | P |
| | | | | | | | |
| | | | | | | | |

BASIC INPUT-OUTPUT SYSTEM (BIOS) READ-ONLY MEMORY (ROM) WITH CAPABILITY FOR VERTICAL SCROLLING OF BITMAPPED GRAPHIC TEXT BY COLUMNS

BACKGROUND OF THE INVENTION

1. Field of the Invention

The present invention generally relates to the art of digital computers, and more specifically to a Basic Input-Output System (BIOS) Read-Only Memory (ROM) with a capability for vertically scrolling bitmapped graphic text by columns.

2. Description of the Related Art

The graphic display capabilities of digital computers are constantly improving. Video modes which provide extremely high resolution and the display of hundreds of colors are now commonplace.

Older video modes such as Color Graphics Adapter (CGA) are almost obsolete. However, it is desirable to provide backward compatibility for the older modes, so that software which was written to use these modes will run on a newer computer.

There are also some applications which can benefit from running in an older, simpler graphics mode. For example, an electronic cash register in a supermarket may display only a few rows of simple text, and need nothing more than what can be provided at high speed and low complexity by a CGA text mode.

In IBM type computers, for example, video display services such as text scrolling are invoked by storing input parameters in computer registers, and generating an interrupt 10h request (the letter "h" following a number indicates that it is a hexadecimal number). To maintain backward compatibility, the video display services that are invoked via interrupt 10h must be located in the computer's Basic Input-Output System (BIOS) Read-Only Memory (ROM) chip.

A video service that is commonly used is vertical scrolling of bitmapped graphic images and text. FIG. 1 illustrates an exemplary computer video display 10 including several windows, more specifically a graphic image window 12, an incoming text window 14, and a status window 16 for a communications program.

The graphic image window 12 may display the program logo, an image that was downloaded, etc. The status window 16 may display the communication status variables of the program. The text window 14 displays incoming text in the form of rows that scroll upwardly such that new rows can be added to the bottom.

Rows of text in bitmapped graphics mode are conventionally scrolled upwardly by rows as illustrated in FIGS. 2*a* to 2*f*. FIG. 2*a* illustrates an initial condition. In FIG. 2*b*, the second row has been scrolled upwardly by one row, with the top row of FIG. 2*a* disappearing off the top of the display 10. The display now includes the original second row which was copied to the top row.

In FIGS. 2*c* to 2*e*, the original third, fourth and fifth rows have been scrolled upwardly by one row, such that the original fifth row is copied to the fourth row. In FIG. 2*f*, the bottom row is blanked so that a new row can be inserted at the bottom.

FIGS. 3*a* to 3*f* are essentially similar to FIGS. 2*a* to 2*f*, except that the display is scrolled downwardly by one row to make room for a new row at the top.

It will be noted that bitmapped video scrolling is not limited to text displays. Graphic images can be scrolled in essentially the same manner.

The CGA standard includes a number of display modes. Those of relevance include text modes 4, 5 and 6. Mode 4 provides a 40 column color display with four colors. Mode 5 provides a 40 column greyscale display with 4 levels. Mode 6 provides an 80 column monochrome display (two color).

European Patent No. 71725, granted Aug. 31, 1988, entitled "METHOD FOR SCROLLING TEXT AND GRAPHIC DATA IN SELECTED WINDOWS OF A GRAPHIC DISPLAY", to J. Bradley, teaches how to scroll bitmapped text rows in CGA modes 4, 5 and 6 as described above with reference to FIGS. 1, 2*a* to 2*f*, and 3*a* to 3*f*. This patent also describes how the text characters are represented by scan lines of pixels (bytes or words) which are stored in two banks in a video display buffer or memory. Even scan lines are stored in one bank, whereas odd scan lines are stored in the other bank.

Scrolling is performed in a "ping-pong" manner, by reading a scan line from the even bank and writing it to a new location in the even bank, reading a scan line from the odd bank and writing it to a new location in the odd bank, and repeating this operation for the remaining scan lines until the text in the window has been scrolled by the designated number of rows.

An improvement to the row-by-row scrolling method presented by Bradley is disclosed in German Patent Application No. 4405330A1, entitled "METHOD FOR SCROLLING SEVERAL SCREEN LINES IN A WINDOW OF A PC MONITOR IN THE GRAPHIC MODE", published Aug. 24, 1995, to G. Paley et al. This patent teaches how to increase the scrolling speed by moving two or more scan lines in one operation.

The prior art is not believed to include any arrangements for vertically scrolling text by columns rather than rows. This is because row-by-row scrolling is able to utilize string instructions which enable an entire scan line to be moved by executing a single instruction, and has an implied speed advantage over column-by-column scrolling which cannot use these instructions.

More specifically, moving a column of text requires a separate set of instructions to be executed for each scan line (byte in CGA mode 6, word in CGA modes 4 and 5) in the column.

A constant equal to the number of bytes in each row (e.g. 80) must be added to the current memory location to point to the next scan line in the column. Then, another instruction must be executed to move the scan line from its original location to a new location in the video memory.

The substantially increased number of instructions required to scroll by columns rather than rows translates directly into a substantially increased length of time required to perform the scrolling operation as understood heretofore. For this reason, vertical scrolling is believed to have been performed only on a row-by-row basis in the prior art.

SUMMARY OF THE INVENTION

In accordance with a method of the present invention, data representing bitmapped graphics and/or text characters is stored in a video memory of a computer. A window is designated that includes contiguous rows and columns of data to be scrolled.

The data in the window is vertically scrolled by columns. One column can be scrolled at a time, or two or more adjacent or alternating columns can be scrolled at a time. The column scrolling method is faster than scrolling by rows when the number of rows in the window is small and/or the number of rows to scroll is high.

Program instructions for implementing the scrolling are preferably included in a Basic Input-Output System (BIOS) Read-Only Memory (ROM) chip to provide a built-in, backward compatible low resolution display capability, e.g. a Color Graphics Adapter (CGA) text display, for a newer computer or other data processing device.

These and other features and advantages of the present invention will be apparent to those skilled in the art from the following detailed description, taken together with the accompanying drawings, in which like reference numerals refer to like parts.

DESCRIPTION OF THE DRAWINGS

FIGS. 2*a* to 2*f* are diagrams illustrating conventional upward text scrolling by rows;

FIGS. 3*a* to 3*f* are diagrams illustrating conventional downward text scrolling by rows;

FIGS. 4*a* to 4*h* are diagrams illustrating text scrolling by columns in accordance with the invention, with one column being scrolled at a time, and the display being scrolled upwardly by one row;

FIGS. 5*a* to 5*h* are similar to FIGS. 4*a* to 4*h,* but illustrate upward scrolling by two rows;

FIGS. 6*a* to 6*h* are similar to FIGS. 4*a* to 4*h,* but illustrate downward scrolling by one row;

FIGS. 7*a* to 7*f* are similar to FIGS. 4*a* to 4*h,* but illustrate upward scrolling two columns at a time by one row;

FIGS. 8*a* to 8*f* are similar to FIGS. 4*a* to 4*h,* but illustrate upward scrolling four columns at a time by one row;

DETAILED DESCRIPTION OF THE INVENTION

The present invention utilizes a discovery by the present inventors such that, under certain conditions using modern computers, vertical scrolling of text in bitmapped graphics mode can be performed faster by scrolling on a column-by-column basis than on the prior art row-by-row basis.

The inventors have discovered that although the length of time required to perform string instructions has decreased as computer technology has advanced, the length of time to perform simple addition and byte or word move instructions has decreased substantially faster.

As described above, scrolling by rows uses string instructions, whereas scrolling by columns uses simple addition and move byte or word instructions. Under certain conditions, including a small number of rows in a window and/or a large number of rows to scroll, the time required to perform scrolling is less when performed by columns rather than rows.

The vertical scrolling speed has heretofore been limited by the speed at which string instructions can be executed, which in turn is limited the speed of the processor. The present invention overcomes this limitation and increases scrolling speed without requiring any advances in computer processing hardware.

A method of vertically scrolling bitmapped text in accordance with the present invention is illustrated in FIGS. 4*a* to 4*h,* to 8*a* to 8*f.* Although the method will be described and illustrated for scrolling bitmapped graphic text, it is also applicable to scrolling bitmapped graphic images.

Figure 1:
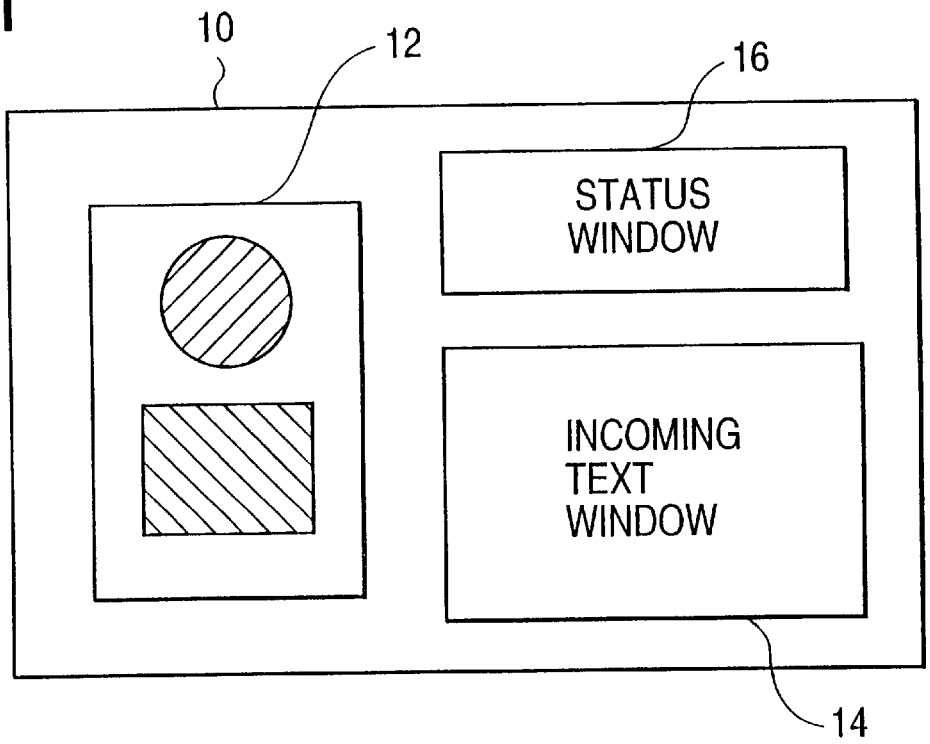
FIG. 1 is a diagram illustrating a video display including a window in which text is to be vertically scrolled.

FIG. 4*a* shows an initial arrangement in which two rows of characters are stored in a portion of a computer video display buffer or memory which is designated as a window for display on a video display screen as illustrated at *14* in FIG. 1. The characters "A", "B" and "C" are located in the second row, whereas the characters "D", "E" and "F" are located in the third row.

FIGS. 4*a* to 4*h* illustrate how the text is scrolled upwardly from the position of FIG. 4*a* by one row, one column at a time, to occupy the first and second rows as illustrated in FIG. 4*h.*

The first step of the process is shown in FIG. 4*b,* in which the character "A" is read from of its original location and written (copied) into the first row above its original position.

It will be noted that the second row still contains the character "A". Next, as shown in FIG. 4*c,* the character "D" is read from the third row and written into the second row to overwrite the character "A", such that the second and third rows of the leftmost column each contain the character "D".

In FIG. 4*d,* the character "B" is read from the second row of the second column and written into the first row thereof. In FIG. 4*e,* the character "E" is copied from the third row of the second column to overwrite the character "B" in the second row.

FIGS. 4*f* and 4*g* illustrate how the characters "C" and "F" are similarly scrolled upwardly in the third column.

As shown in FIG. 4*g,* the third row still contains the characters "D", "E" and "F" which were scrolled upwardly to the second row. The step of FIG. 4*h* is to fill the third row with blank characters (attributes) such that the third row appears to be blank on the display.

FIGS. 5*a* to 5*h* are similar to FIGS. 4*a* to 4*h,* except that the two rows of characters are scrolled upwardly by two rows rather than one row. More specifically, the characters are originally located in the third and fourth rows as shown in FIG. 5*a,* and are scrolled upwardly to the first and second rows as shown in FIG. 5*h.*

FIGS. 6*a* to 6*h* are similar to FIGS. 4*a* to 4*h,* except that the two rows of characters are scrolled downwardly by one row. More specifically, the characters are originally located in the second and third rows as shown in FIG. 6*a,* and are scrolled downwardly to the third and fourth rows as shown in FIG. 6*h.* It will be understood that text can be scrolled downwardly by more than one row in the manner described above with reference to FIGS. 5*a* to 5*h.*

It is further within the scope of the invention to scroll more than one column, but not all of the columns, at a time.

FIGS. 7*a* to 7*e* illustrate how two rows of characters are scrolled upwardly by one row, two columns at a time.

In FIG. 7*b,* the characters "A" and "B" are copied together from the second row to the first row. In FIG. 7*c* the characters "E" and "F" are copied from the third row to the second row to overwrite the characters "A and B". IN FIG. 7*d* the characters "C" and "D" are copied from the second row to the first row, whereas in FIG. 7*e* the characters "G" and "H" are copied from the third row to the second row. The third row is blanked or filled in FIG. 7*f.*

FIGS. 8*a* to 8*f* illustrate how two rows of characters can be scrolled upwardly by one row, four columns at a time. The method is essentially similar to that described above with reference to FIGS. 7*a* to 7*f.*

As will be described in detail below, in CGA mode 6, each scan line of a character is represented by one byte (8 bits) of data in memory. In CGA modes 4 and 5, each character is represented by two bytes (16 bits) of data. Taking mode 6 for example, scrolling by one column at a time is performed by moving bytes, scrolling by two columns at a time is performed by moving words, and scrolling by four columns at a time is performed by moving double words (32 bits). Instructions for moving bytes, words, and double words are included in the instruction sets of essentially every modern digital computer.

The invention also includes accommodating windows having numbers of columns that are not integral multiples of the number of columns being moved. For example, it will be assumed that a window includes 11 columns, and scrolling is being performed 4 columns at a time. The first 8 columns will be scrolled in the first two operations, resulting in 3 columns remaining to be scrolled.

Since 3 is less than 4, the remaining 3 columns cannot be scrolled in the same manner as the first 8 columns. The present method includes detecting such a condition, and changing the scrolling mode such that subsequent scrolling will be performed using a smaller number of columns at a time.

In the example presented above in which 3 columns remain to be scrolled, two options are possible. The first option is to scroll the next two columns together, and then scroll the last column by itself. The second option is to scroll the three columns, one column at a time. Thus, the options are to scroll 4, 2, or 1 columns at a time, or to scroll 4 or 1 column at a time depending on the number of columns remaining to be scrolled.

The following table illustrates how vertical scrolling peed is increased in accordance with the invention.

TABLE

| Rows | Columns | Scroll | By Rows | 1-Column | 2-Column | 4-Column |
|---|---|---|---|---|---|---|
| 25 | 80 | 1 | 12229 | 25183 | 12623 | 6343 |
| 25 | 40 | 1 | 8229 | 12623 | 6343 | 3203 |
| 12 | 80 | 1 | 5885 | 12703 | 6383 | 3223 |
| 25 | 80 | 12 | 11877 | 21663 | 10863 | 5463 |
| 25 | 40 | 12 | 7877 | 10863 | 5463 | 2763 |
| 12 | 40 | 6 | 3805 | 5583 | 2823 | 1443 |
| 5 | 10 | 1 | 1069 | 803 | 433 | 359 |
| 5 | 40 | 1 | 1669 | 3023 | 1543 | 803 |
| 10 | 80 | 5 | 4781 | 9503 | 4783 | 2423 |
| 10 | 40 | 5 | 3181 | 4783 | 2423 | 1243 |
| 20 | 40 | 10 | 6301 | 8783 | 4423 | 2243 |

The parameters in the TABLE are the numbers of rows and columns in the window in which text is to be scrolled, and the number of rows "Scroll" by which the text is to be scrolled. Comparison is made for prior art scrolling by rows, and for scrolling by one column, two columns, and four columns at a time in accordance with the present invention. The numbers in the fourth through seventh columns are Pentium processor cycles.

The data in the TABLE was calculated using the following formulas.

C=Columns

R=Rows

S=Scroll

By Rows: 4(R−S)(42+C)+4S(34+C)+61

One Column: C(18+12R−4S)+63

Two Column: INT(C/2)*(18+12R−4S)+63+((C MOD 2)*(18+12R−4S))

Four Column: INT(C/4)*(18+12R−4S)+63+((C MOD 4)*(18+12R−4S))

INT(x)=lowest integer less than the value.

Example: INT(4.9)=4 x MOD y=Remainder when x is divided by y.

Example: x=5, y=3, x MOD y=2

It will be seen that scrolling one column at a time is slower than scrolling by rows except for the case of 5 rows, 10 columns, and one scroll row. Scrolling by two columns at a time is faster than scrolling by rows except in three cases. Scrolling by four columns at a time is faster than scrolling by rows in all cases.

In general, the scrolling speed according to the present invention increases relative to the prior art as the number of rows decreases and/or the number of rows to scroll increases. The scrolling speed further increases as the number of columns that are scrolled at a time is increased.

Although the present invention is preferably practiced using only scrolling by columns, the scope thereof is not so limited. The invention can be optimized to scroll by columns when it is faster than scrolling by rows, and scroll by rows when it is faster than scrolling by columns. The crossover point will vary depending on a particular processor and application, and can be calculated in real time, or predetermined based on previous calculations and/or empirical data.

Figure 9:
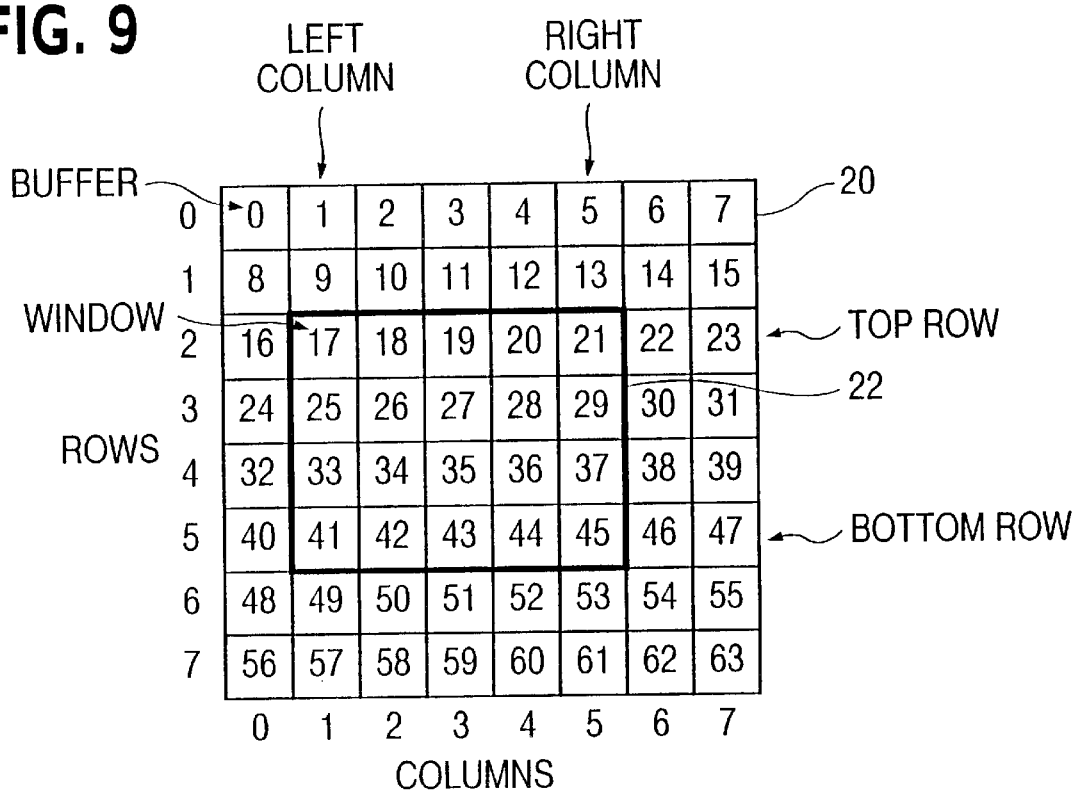
FIG. 9 is a simplified diagram illustrating the arrangement of a video display buffer and text scrolling window.

FIG. 9 illustrates the geometry and parameters used by the present invention in defining a window in a video display buffer or memory and vertically scrolling text within the window. For simplicity, it will be assumed that the video memory 20 has a capacity for storing 64 text characters in an arrangement of 8 rows and 8 columns. One character is stored in each location in the memory 20 which is specified by a row/column combination.

The locations are numbered as 0 to 63, and the rows and columns are each numbered as 0 to 7.

The parameter "Buffer" is used to specify the upper left row/column location in the memory 20, which in the illustrated example is Buffer=0. It will be assumed that a window 22 is designated which contains a block of contiguous rows and columns of text to be scrolled. As shown, the window 22 encloses the locations 17 to 21, 25 to 29, 33 to 37, and 41 to 45. A parameter Window specifies the upper left location in the window 22, such that Window=17.

Two parameters specify the upper and lower rows of the window 22, more specifically Top Row=2 and Bottom Row=5. Two parameters similarly specify the leftmost and rightmost columns of the window, more specifically Left Column=1 and Right Column=5.

The width of the window 22 is calculated as

Width=Right Column−Left Column+1=5−1+1=5

The height of the window 22 is calculated as

Height=Bottom Row−Top Row+1=5−2+1=4

It will be assumed that the text is to be scrolled by two rows, or

Scroll (Rows to Scroll)=2

The number of rows which must be moved vertically during the scrolling operation is calculated as Rows to Move=Height−Rows to Scroll=4−2−2

For scrolling upwardly, the destination row into which the first scrolled line is to be copied is the Top Row, or Destination Row=2

The destination column is the Left Column, or

Destination Column=1

The destination memory location into which the first character is to be copied is Destination=(Destination Row×8)+Destination Column=(2×8)+1=17

The source memory location from which the first character will be read is

Source=Destination+(Rows to Move×8)=17+(2×8)=33

Thus, the first character will be read from memory location 33 and copied into memory location 17, for a movement of two rows upward in column 1.

For scrolling downwardly, the destination row into which the first scrolled line is to be copied is the Bottom Row, or Destination Row=5

The destination column is the Left Column, or

Destination Column=1

The destination memory location into which the first character is to be copied is Destination=(Destination Row×8)+Destination Column=(5×8)+1=41

The source memory location from which the first character will be read is

Source=Destination 1 (Rows to Move×8)=41+(2×8)=25

Thus, the first character will be read from memory location 25 and copied into memory location 41, for a movement of two rows downward in column 1.

Subsequent characters will be moved one, two, or four columns at a time as described with reference to FIGS. 4*a* to 4*h,* to 8*a* to 8*f,* depending on the number of rows to be scrolled and the number of columns to be scrolled at a time.

As described with reference to FIG. 9, each character was assumed to be stored in a single row/column memory location for simplicity of explanation. FIGS. 10*a* and 10*b* to 13 illustrate the actual CGA modes and the manner in which bitmapped text data is stored in the video memory.

Each character is made up of a matrix of pixels, including scan lines that are stored in different places in the video memory. However, there is a direct mapping between the character locations which were described with reference to FIG. 9 and the actual locations in the video memory, so that the two can be considered as equivalent and interchangeable. The following description presents the present invention in more detail, proceeding from the character level to the scan line and pixel level.

Figure 10A:
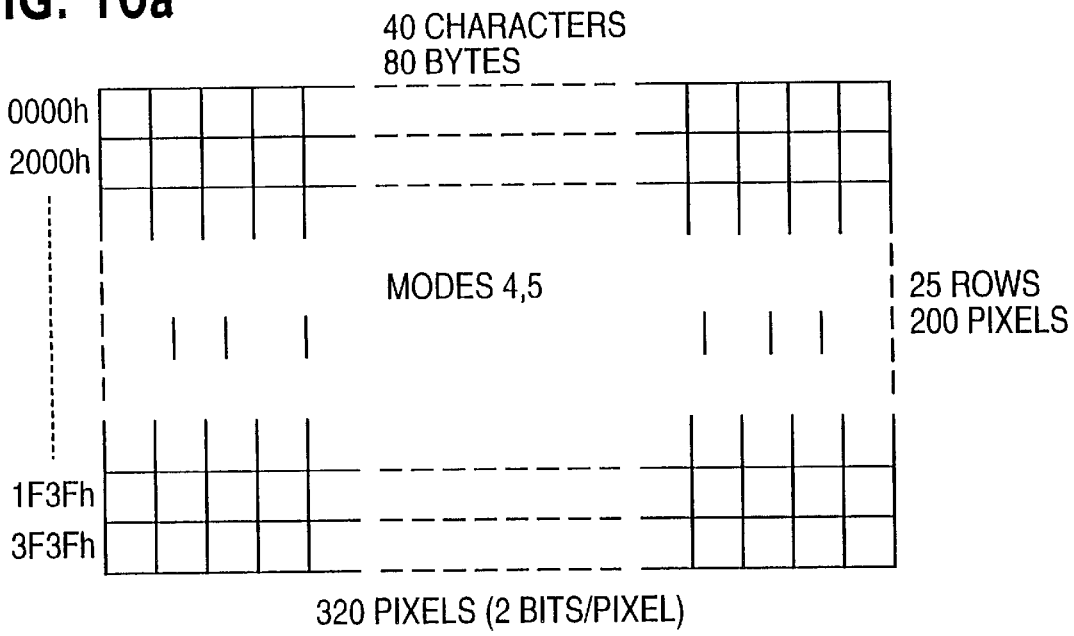
FIGS. 10*a* and 10*b* and 11 are diagrams illustrating the arrangement of a CGA video mode 4 or 5 display buffer.

FIGS. 10*a,* 10*b* and 11 illustrate the arrangement of CGA modes 4 and 5. As shown in FIG. 10*a*, the entire video memory 20 stores data representing 40 columns×25 rows of text characters, with each character being represented by a matrix of 8 pixels×8 pixels. Thus, the entire display consists of 40 columns×8 pixels=320 horizontal pixels, and 25 columns×8 pixels=200 vertical pixels.

Each character includes 8 horizontal scan lines, each consisting of 2 bytes (16 bits) . Since each character includes 8 horizontal pixels, each pixel is represented by 2 bits. Thus, each pixel can have one of four colors (CGA mode 4) or one of four levels of grey (CGA mode 5). The total number of bits required for the video memory is 80 bytes/row×25 rows×8 bits/byte=16,000 bits.

Figure 10B:
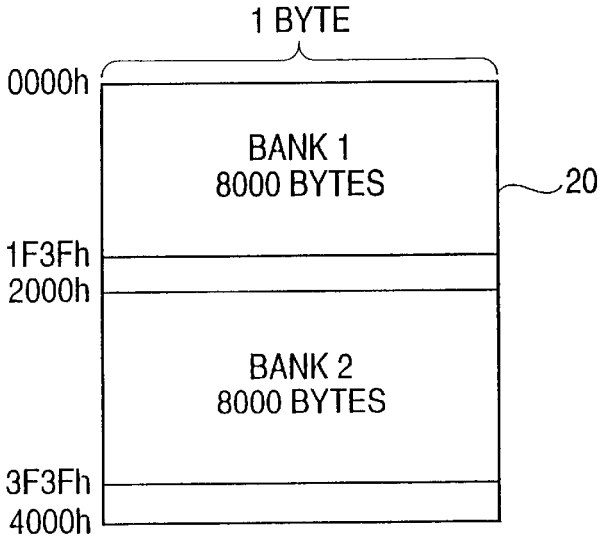

As shown in FIG. 10*b,* the video memory stores one byte at each memory location, and is divided into two banks of 8,000 10 bytes each. Bank 1 stores even scan lines, whereas Bank 2 stores odd scan lines. Although Bank 1 requires only 8,000 bytes, Bank 2 begins at 2000h which is 8192 bytes from the beginning of Bank 1.

Figure 11:
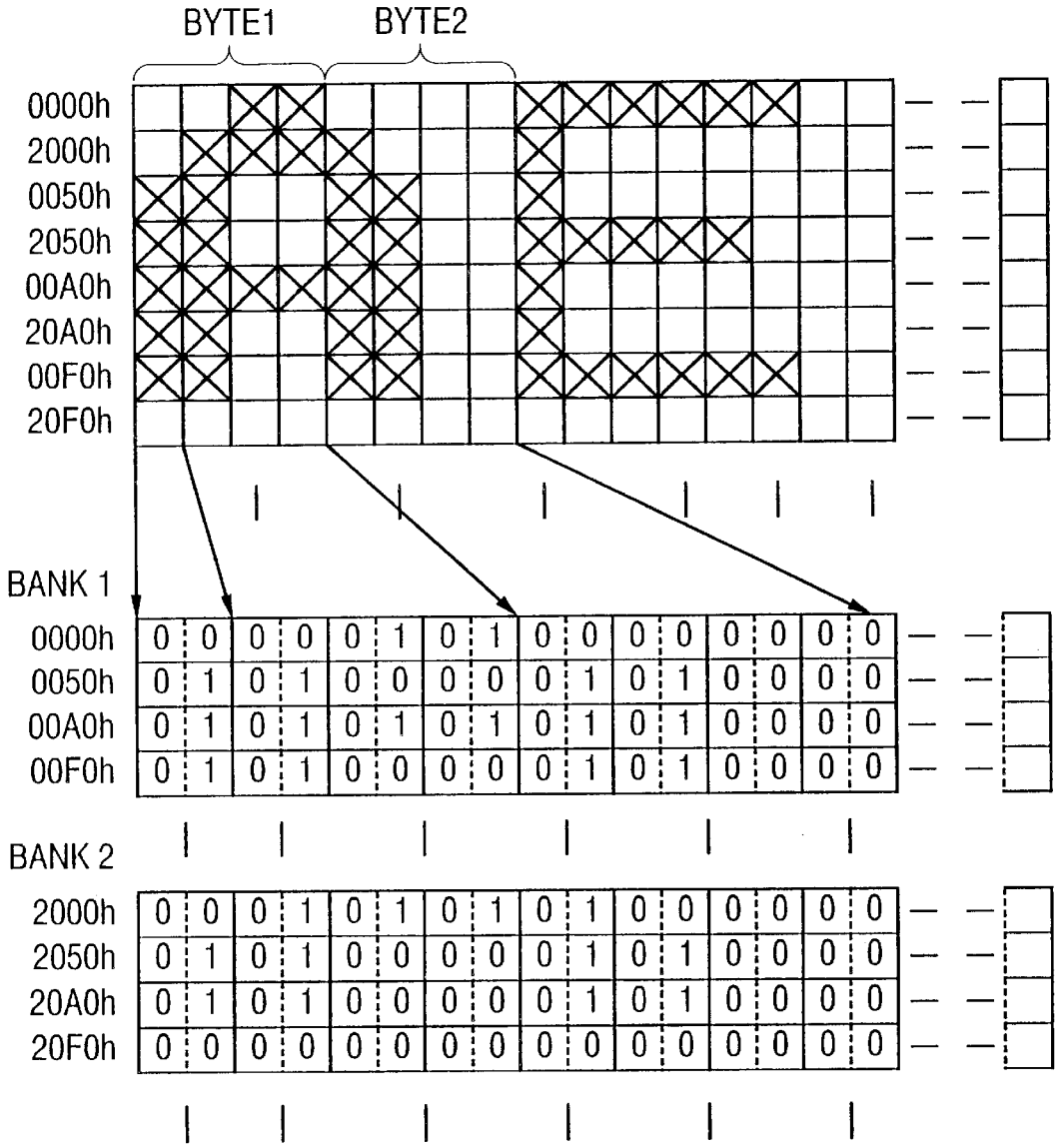

This relationship is shown in more detail in FIG. 11, which illustrates the leftmost two characters, e.g. "A" and "C", in the first row of the memory. The first scan line (2 bytes) of the character "A" is stored at locations 0000h and 0001h respectively in Bank 1. The second scan line is stored in locations 2000h and 2001h in Bank 2. The third scan line is stored in locations 0050h and 0051h in Bank 1, the fourth scan line is stored in locations 2050h and 2051h in Bank 2, etc.

Figure 12A:
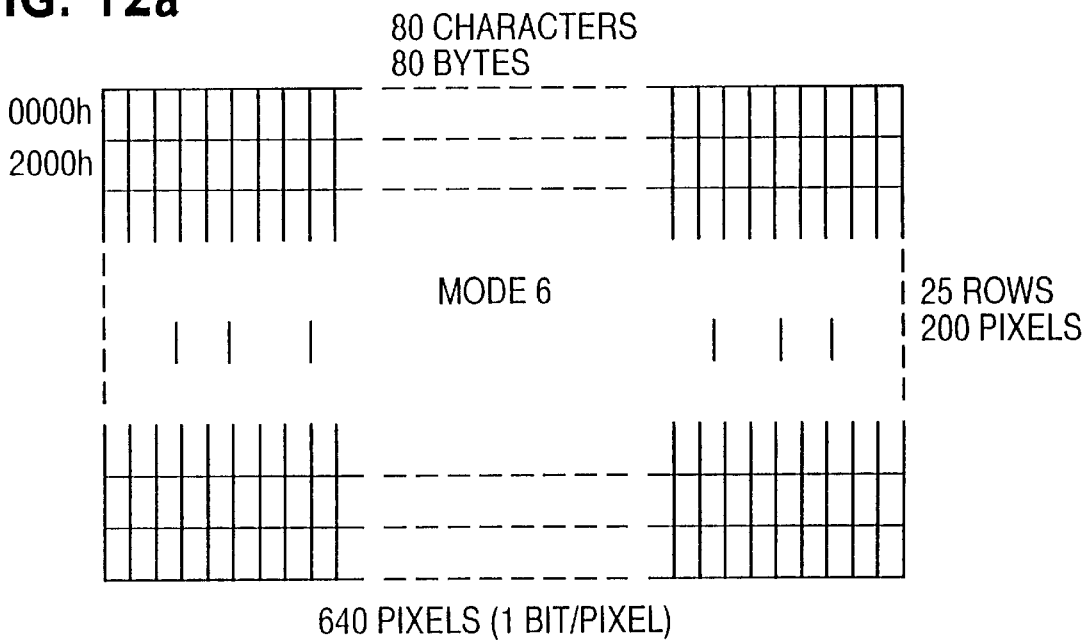
FIGS. 12*a* and 12*b* and 13 are diagrams illustrating the arrangement of a CGA video mode 6 display buffer.

FIGS. 12*a,* 12*b* and 13 illustrate the arrangement of CGA mode 6. As shown in FIG. 12*a,* the entire video memory stores data representing 80 columns×25 rows of text characters, with each character being represented by a matrix of 8 pixels×8 pixels. Thus, the entire display consists of 80 columns×8 pixels=640 horizontal pixels, and 25 columns×8 pixels=200 vertical pixels.

Each character includes 8 horizontal scan lines, with each scan line consisting of 1 byte (8 bits). Since each character includes 8 horizontal pixels, each pixel is represented by 1 bit. Thus, each pixel can have one of two colors (e.g. black and white). The total number of bits required for the video memory is 80 bytes/row×25 rows×8 bits/byte=16,000 bits, the same as for CGA modes 4 and 5.

Figure 12B:
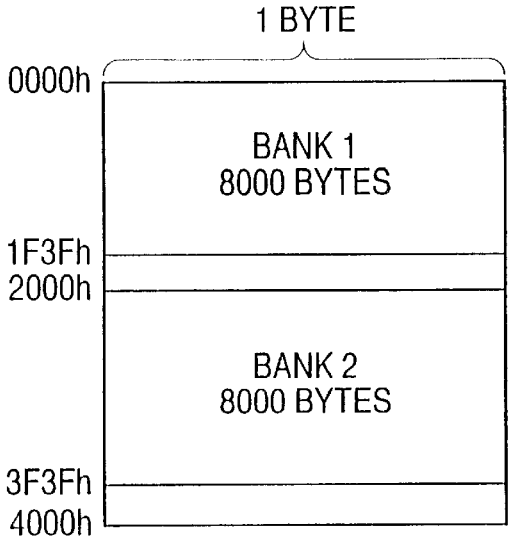

As shown in FIG. 12*b,* the video memory 20 stores one byte at each memory location, and is divided into two banks of 8,000 bytes each. Bank 1 stores even scan lines, whereas Bank 2 stores odd scan lines, the same as for CGA modes 4 and 5.

Figure 13:
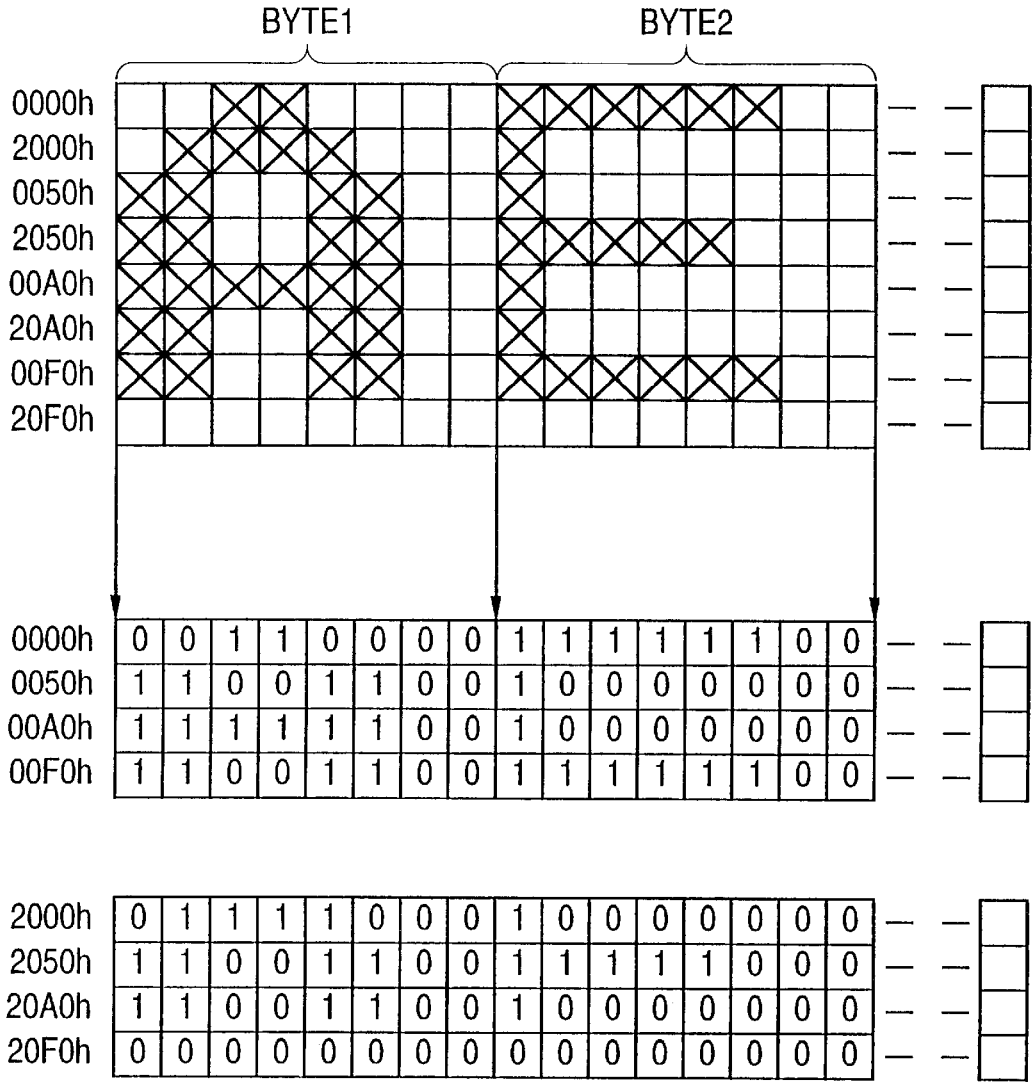

FIG. 13 illustrates the leftmost two characters, e.g. "A" and "C", in the first row of the memory. The first scan line (1 byte each) of the characters "A" and "C" are stored at locations 0000h and 0001h respectively in Bank 1. The second scan lines are stored in locations 2000h and 2001h in Bank 2. The third scan lines are stored in locations 0050h and 0051h in Bank 1, the fourth scan lines are stored in locations 2050h and 2051h in Bank 2, etc.

Figure 14:
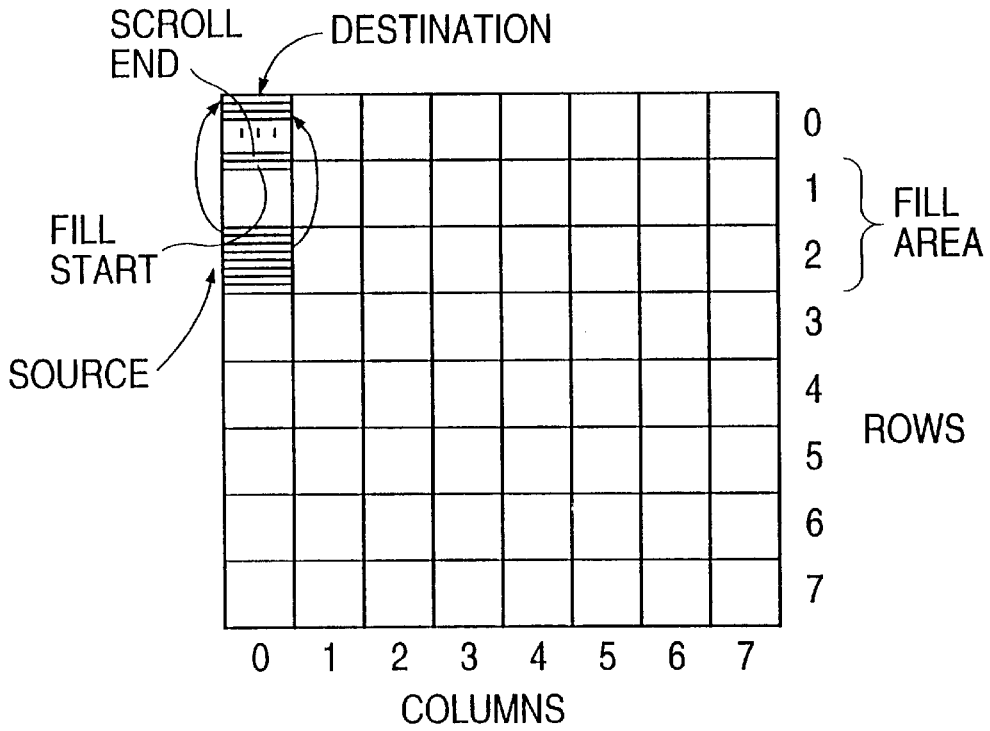
FIGS. 14 and 15 are diagrams illustrating how a column of character scan lines is scrolled and filled upwardly and downwardly respectively.
Figure 15:
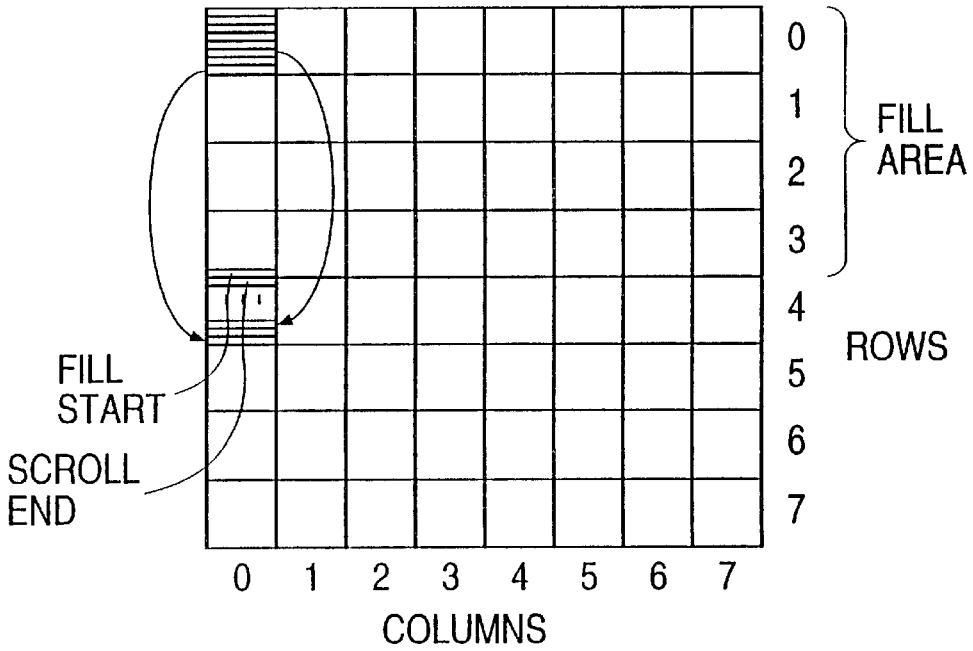

FIGS. 14 and 15 illustrate how columns of text are scrolled on the scan line level. FIG. 14 illustrates an example of one character being scrolled upwardly by two rows in a window, from a source location in row 2 to a destination location in row 0. All of the even scan lines (2 bytes for CGA modes 4 and 5, 1 byte for CGA mode 6) are read out of their source locations in Bank 1 of the memory 20, and written (copied) to destination locations in Bank 1. For scrolling up, the scan lines are read out of the memory from the top of the character downwardly.

Since the text is being scrolled up by two rows, two rows must be filled with blank characters underneath. Thus, rows 1 and 2 must be filled. This is facilitated by the fact that after scrolling all of the scan lines of the character in Bank 1, the memory address pointer has been incremented to the location of the first location to fill (Fill Start).

The fill operation is then performed by writing a blank character attribute or code (e.g. 00h) to the scan line locations for the characters in rows 1 and 2 of column 0. This will not cause a problem regarding overwriting row 2, since the necessary even scan lines have already been copied to row 0.

The operations described above are then repeated for the odd scan lines stored in Bank 2. The result is that the character is scrolled upwardly by two rows, and all memory locations which were read from but not written to are filled with blank characters.

FIG. 15 illustrates a similar operation in which a character in row 0 is scrolled downwardly by 4 rows. The operation is similar to that of FIG. 14, except that the character is scrolled from the bottom scan line upwardly. The Fill Start location is automatically defined as the next location above the last scan line which was scrolled.

FIGS. 16*a* to 16*e* in combination constitute a flowchart of a preferred implementation of the present invention. In this example, scrolling is performed two columns at a time until a single remaining column is reached, at which time the scrolling mode is changed to one column at a time. This particular embodiment is directly backwardly compatible with all processors used in PC compatible computers and all existing standards (e.g. including 4 column displays).

Some of the process steps include notation such as "$*=_2$"which is taken from the C programming language. The notation "width*=2", for example, indicates that the parameter "width" is to be multiplied by 2, and the old value overwritten by the new value.

Figure 16A:
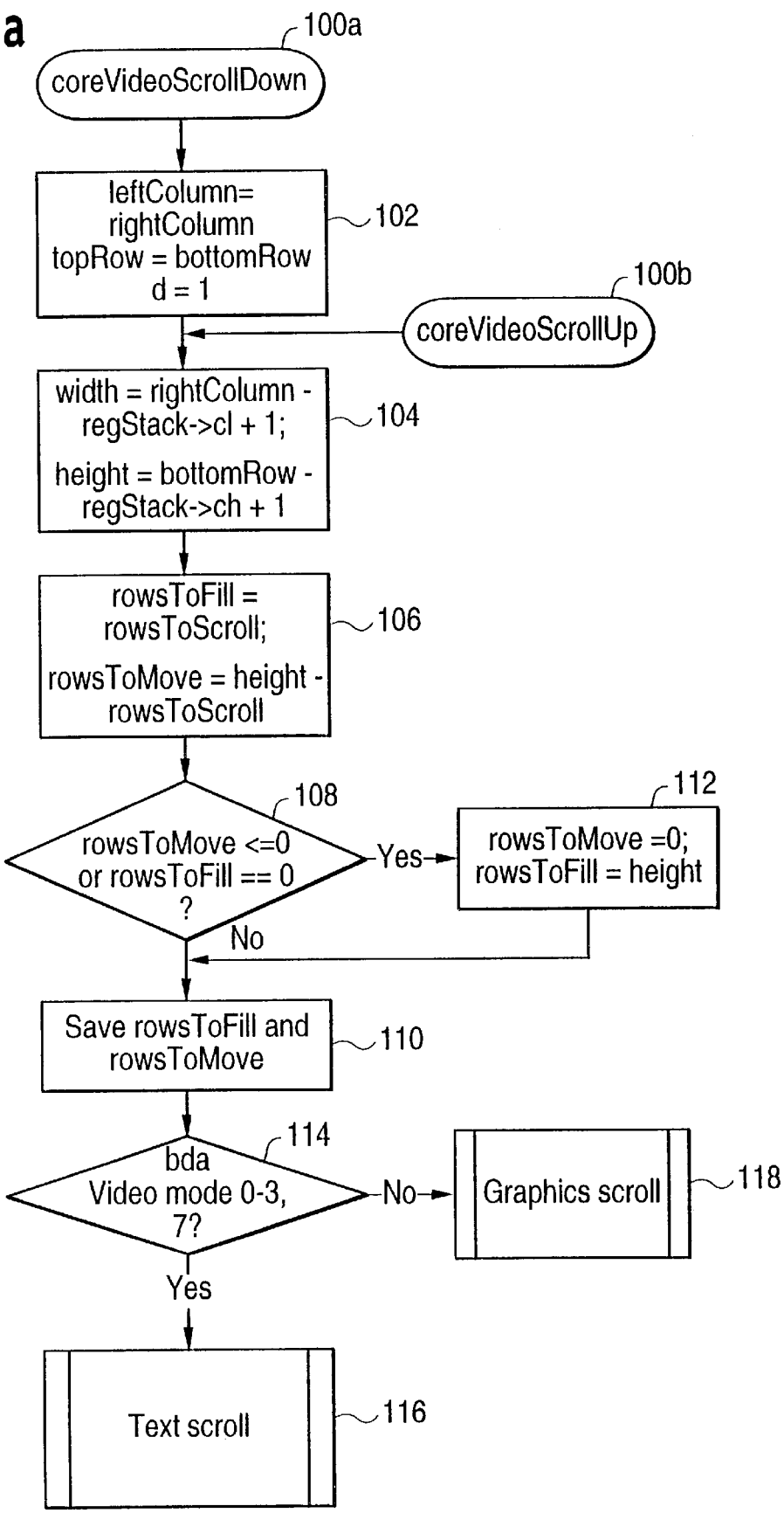
FIGS. 16*a* to 16*e* in combination constitute a detailed flowchart of the present column scrolling method.

The process is begun from one of two entry points in FIG. 16*a,* depending on whether scrolling is to be performed upwardly or downwardly. The scrolling operation is invoked by passing in variables that were described above with reference to FIG. 9 in registers, and generating an interrupt 10h request which internally pushes the variables onto the stack and sets up a variable "bp" which points to them. The variables are accessed using a data structure "regStack". These operations produce a standard IBM core video request for BIOS service, in this case a text scroll up or scroll down service.

Sample code for calling interrupt 10h is as follows.

```
mov ah,6
mov al,1
mov cl,5
mov ch,5
mov dl,10
mov dh,10
int 10h
```

The code which is executed by interrupt 10h performs the following basic flow.

```
pusha          ; Save all registers on the stack
mov bp,sp      ; bp =3D sp (and is now a pointer to
                 regStack)
.
.
.
check function in ah and jump to appropriate routine
.
.
popa
iret
```

If scrolling is to be downward, the entry point is designated as step 100*a,* whereas the entry point is 100*b* for upward scrolling. For downward scrolling, a step 102 is performed which comprises setting the left column equal to the right column, top row equal to the bottom row, and a string direction flag d=1. These operations are not relevant to the invention, but are included for compatibility with the existing BIOS services.

The next step 104 includes calculating the width and height of the window in which the bitmapped text is to be scrolled in the manner described with reference to FIG. 9. The values of left column and bottom row which are used in the calculations are not the values which were changed in step 102, but are original values "cl" and "ch" respectively that were stored in the register stack "regStack" after invoking the interrupt 10h.

In a step 106, the rows to fill is set equal to the rows to scroll as described above with reference to FIGS. 14 and 15. The number of rows to move is calculated as being equal to the height of the window minus the number of rows to scroll.

Step 108 is a decision block which enables the window to be cleared or blanked rather than performing text scrolling per se. The calling function can set the number of rows to scroll as being greater than the difference between the bottom row and the top row, or the number of rows to scroll as being zero. Either of these conditions designates that the window is to be cleared.

If the result of step 108 is no, the method proceeds to a step 110 which is to save the calculated numbers of rows to fill and rows to move. If the result is yes, a step 112 is performed which sets the number of rows to move equal to 0, and the number of rows to fill as being equal to the height of the window. These parameters will cause the window to be cleared or filled with blank attribute characters upon execution of the remainder of the process.

Step 114 tests to see if the requested BIOS service was bda (BIOS Data Area) CGA video mode 0 to 3, or 7. These are text (not bitmapped graphic) modes which are not related to the scrolling operation of the invention. If the result is yes, a text scroll operation 116 is performed which is not part of the invention and will not be described in detail. If the result is no, indicating CGA video mode 4, 5 or 6, a step 118 is performed which consists of performing a graphics scroll routine that is illustrated in FIG. 16*b*.

Figure 16B:
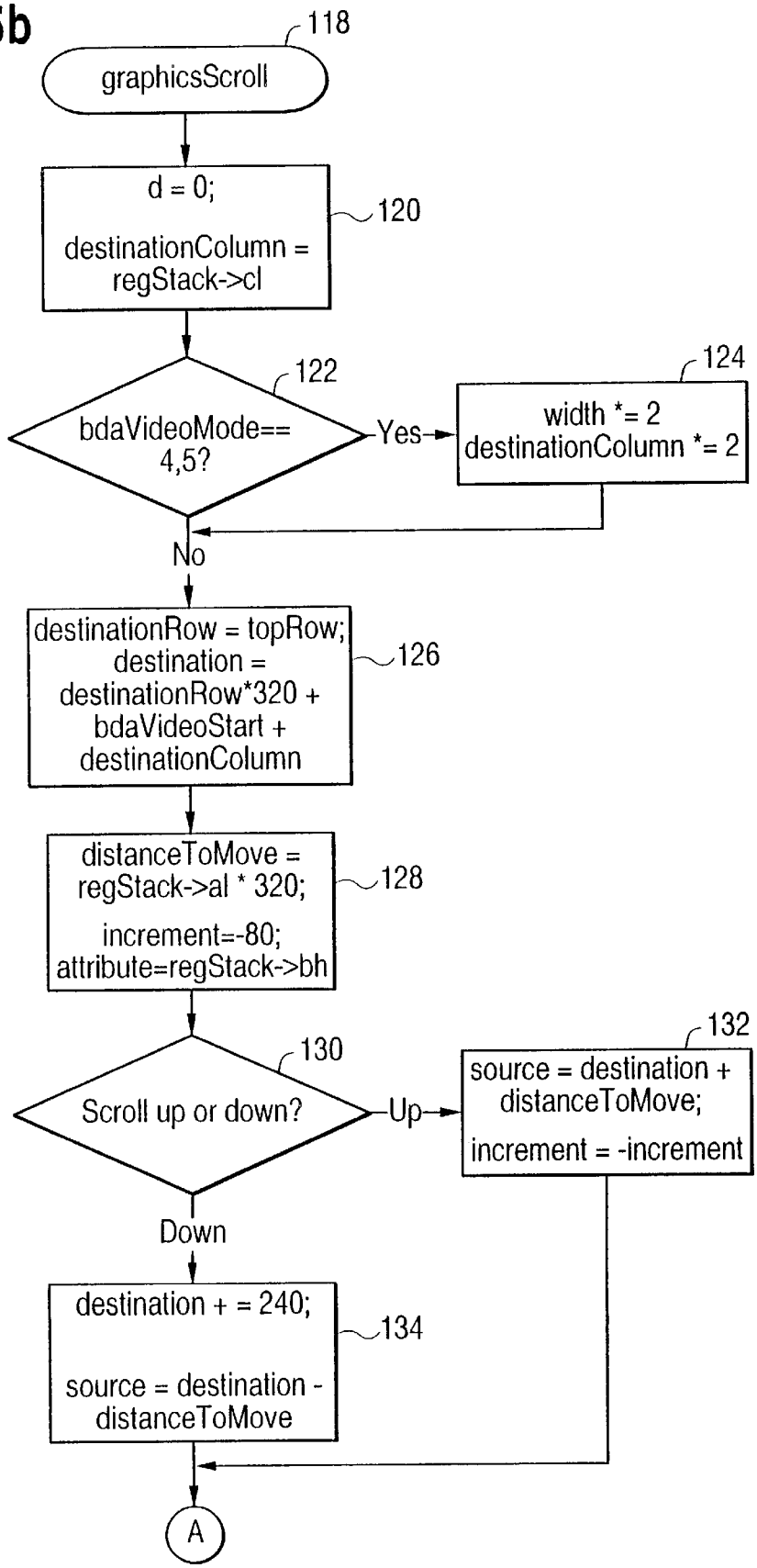

As viewed in FIG. 16*b*, a first step 120 after the graphics scroll routine 118 is entered sets the direction flag d=0 to maintain compatibility with the existing BIOS services. The flag "d" is a string direction flag which is d=1 for backward and d=0 for forward. Step 120 also sets the destination column as being equal to the original left column value "cl" from the register stack.

Step 122 tests to see if the video mode is 4,5 or 6. If it is mode 4 or 5, the values of width and destination column are multiplied by two in a step 124 to reflect the two byte scan lines in these 40 column modes.

In a step 126, the destination row is set equal to the top row. It will be noted that, for downward scrolling, the value of the top row was set to the value of the bottom row in step 102. Step 126 also calculates the value of destination as being equal to the destination row×320+bda video start+destination column. The destination row is multiplied by 320 because each row consists of 80 bytes×4 rows=320 bytes in Bank 1 (even scan lines) or Bank 2 (odd scan lines) of the memory. The CGA controller can support multiple display pages. Bda video start is the address of the video page in the BIOS data area in which the data is stored.

Step 128 calculates a distance to move as being equal to a value "al" which represents the number of rows to scroll obtained from the register stack×320. The distance to move is the difference between the initial source location and destination location in Bank 1 or Bank 2. Step 128 also sets an increment variable as being equal to −80, which is based on the value of 80 bytes/scan line. Step 128 also sets the value of an attribute to the value specified by a value "bh" in the register stack. The attribute is the code (e.g. 00h) which is to be written into the rows that are to be filled.

Step 130 tests to see if scrolling is to be up or down. For upward scrolling, a step 132 is performed which calculates the source location as being equal to the value of destination+distance to move, and inverts the sign of the increment value. The increment value is now +80, which will result in upward scrolling as described above with reference to FIG. 14.

For downward scrolling, 240 (320 bytes/scan line−80 bytes for one scan line) is added to the value of destination to point to the bottom scan line of the first character to scrolled downwardly. The source location is calculated as being equal to the value of destination−distance to move. The increment value is −80, which will result in downward scrolling as described above with reference to FIG. 15.

Figure 16C:
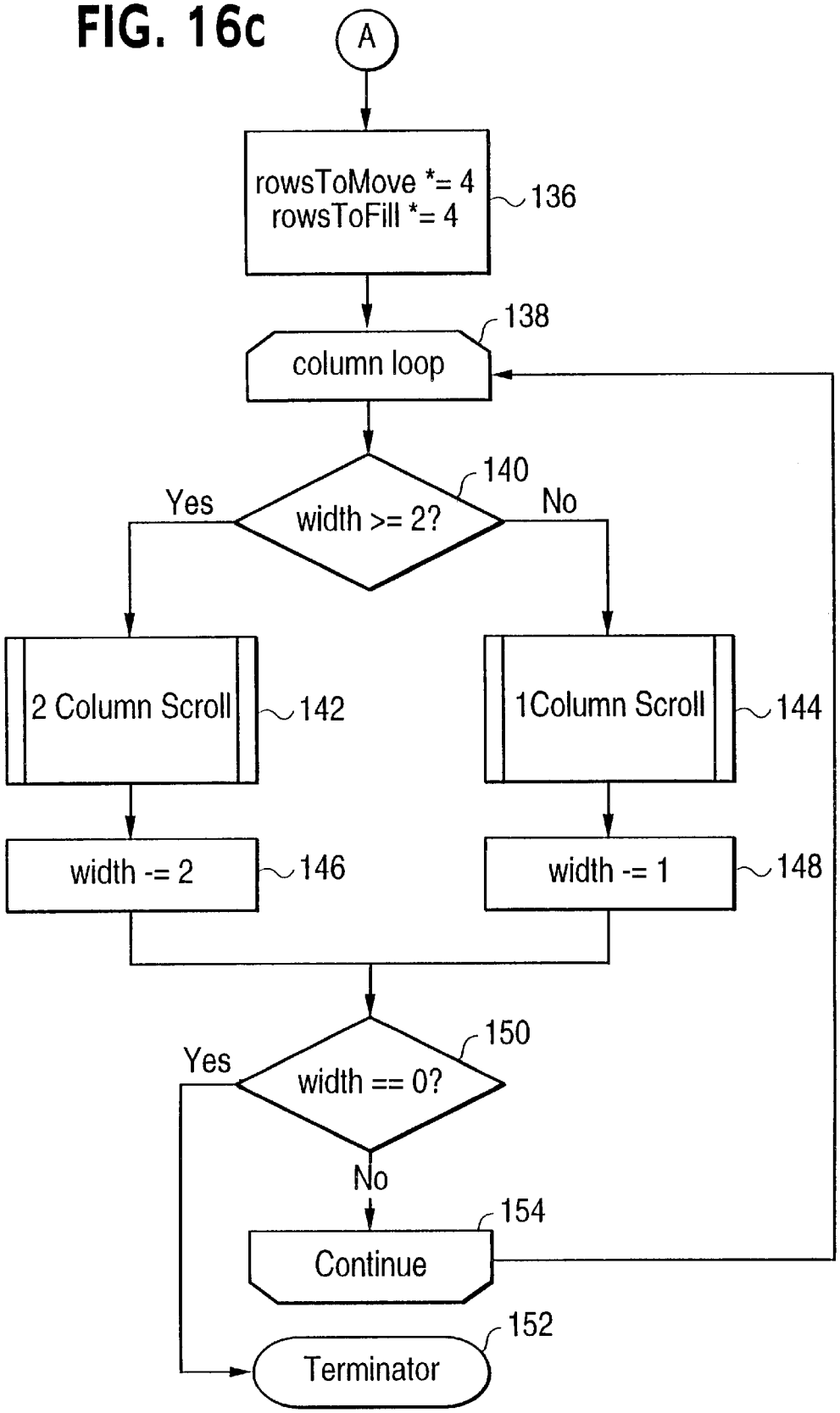

The graphics scroll routine is continued in FIG. 16*c* as indicated by a link "A". In a step 136, the values of rows to move and rows to fill are multiplied by 4, since these values are now being used to count scan lines rather than character rows, and there are four scan lines/row in Bank 1 and Bank 2.

The process then enters a column loop at 138 which performs the actual scrolling operation.

Figure 16D:
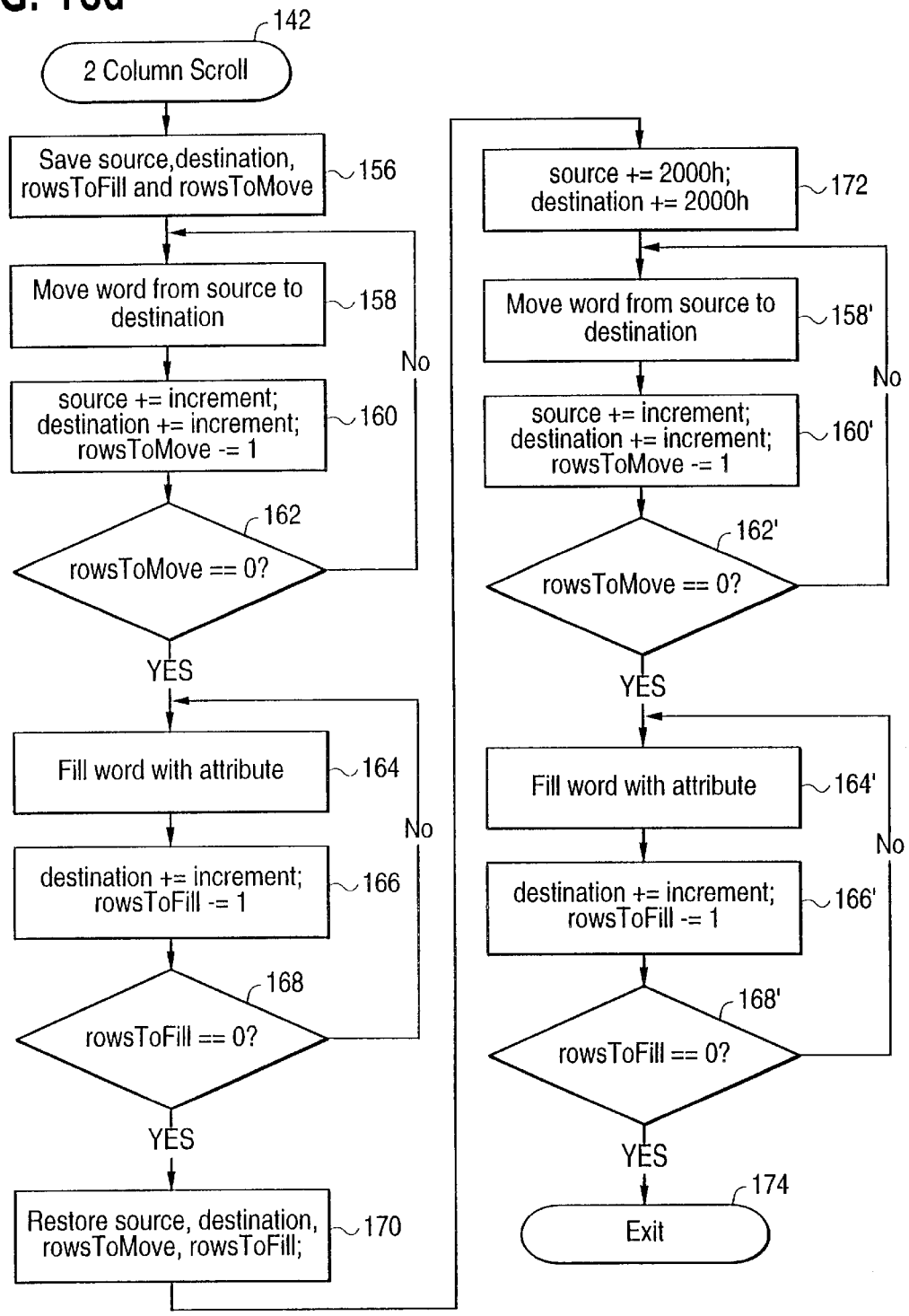

The value of width is now being used to denote the number of columns remaining to be scrolled. If the width is greater than 2, the process executes a 2 column scroll routine 142 which is illustrated in FIG. 16*d*. If only column remains to be scrolled, the processes executes a 1 column scroll routine which is illustrated in FIG. 1*e*.

After performing a two column scroll, a step 146 is performed which decrements the value of width by 2. After performing a one column scroll, a step 148 is performed which decrements the value of width by 1.

A step 150 tests to see if the value of width has been reduced to zero, which means that there are no more columns to scroll. If the decision is yes, the process terminates at 152. If the decision is no, the process loops back to step 138 to scroll more columns as indicated at 154.

As illustrated in FIG. 16*d*, the two column scroll routine 142 begins at a step 156 in which the values of source, destination, rows to fill and rows to move are stored. Step 158 copies a word (2 bytes) from the source to the destination.

Step 160 increments the values of source and destination and decrements the value of rows to move. Step 162 tests to see if the value of rows to move has been decremented to zero. If no, the process loops back to step 158. If yes, the process continues to a step 164.

The result of performing steps 158, 160 and 162 is that all of the odd scan lines in two columns have been scrolled in Bank 1 of the memory. The last execution of step 160 results in the values of source and destination pointing to the beginning of the fill area as described above with reference to FIGS. 14 and 15.

Step 164 stores the blank attribute code in the first word of the fill area. Step 166 increments the value of destination and decrements the value of rows to fill. Step 168 tests to see if all required rows have been filled. If no, the process loops back to step 164. If yes, the process continues to a step 170 which restores the values of source, destination, rows to fill and rows to move that were stored in step 156.

The next step is 172, which adds 2000h to the values of source and destination. These values now point to the beginning of the odd rows to scroll in Bank 2 of the memory. Steps 158' to 168' are then performed which are identical to the steps 158 to 168 except that the odd scan lines in Bank 2 are scrolled and filled. The routine 142 exits at 174 and returns to step 146.

Figure 16E:
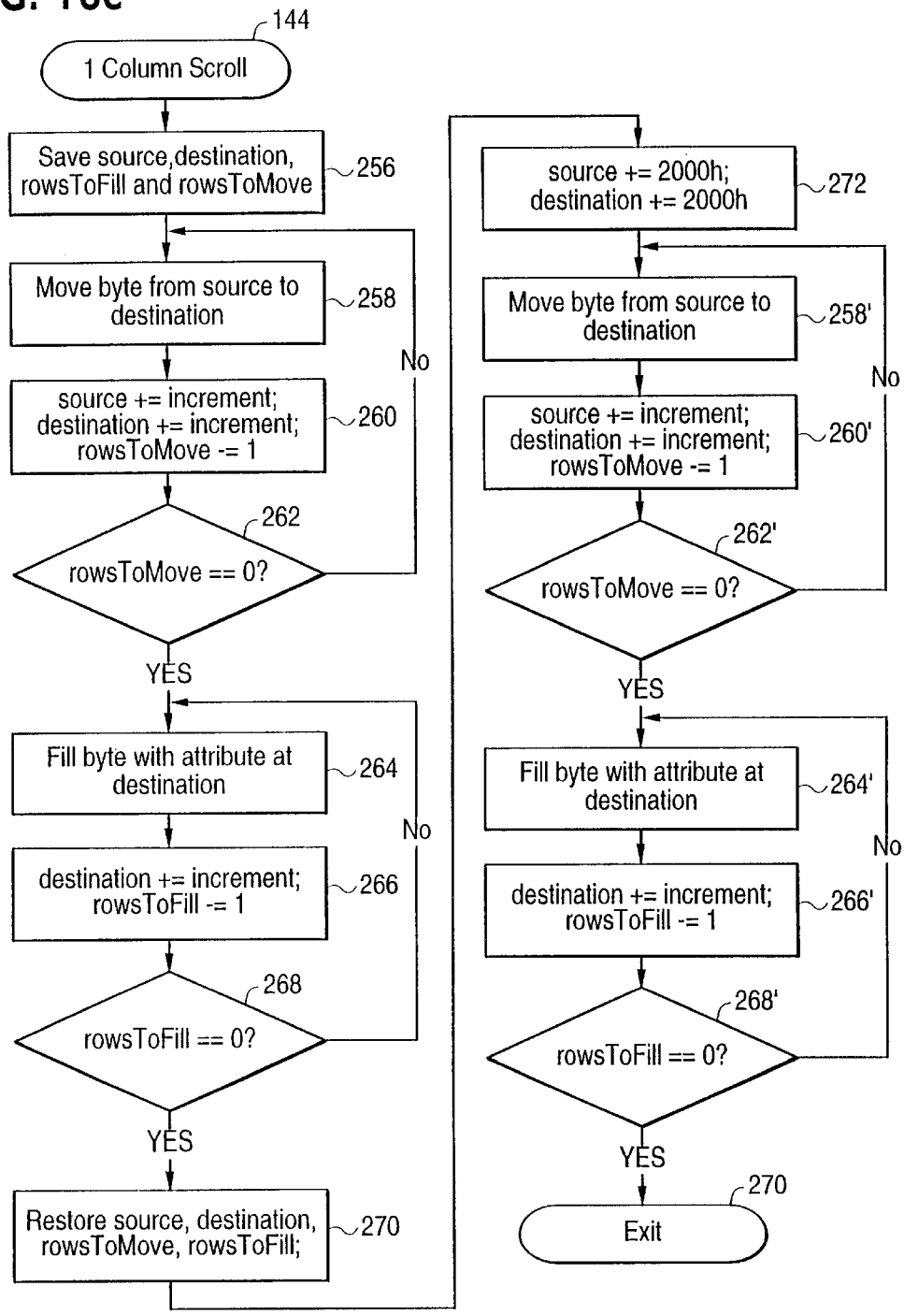

The routine 144 as illustrated in FIG. 16*e* for scrolling one column is essentially similar to the two column stroll routine of FIG. 16*d*. Like steps are designated in FIG. 16*e* by the reference numerals used in FIG. 16*d* incremented by 100.

The routine 144 differs from the routine 142 in that the steps 258 and 258' move one byte, rather than one word, from source to destination.

Figure 17:
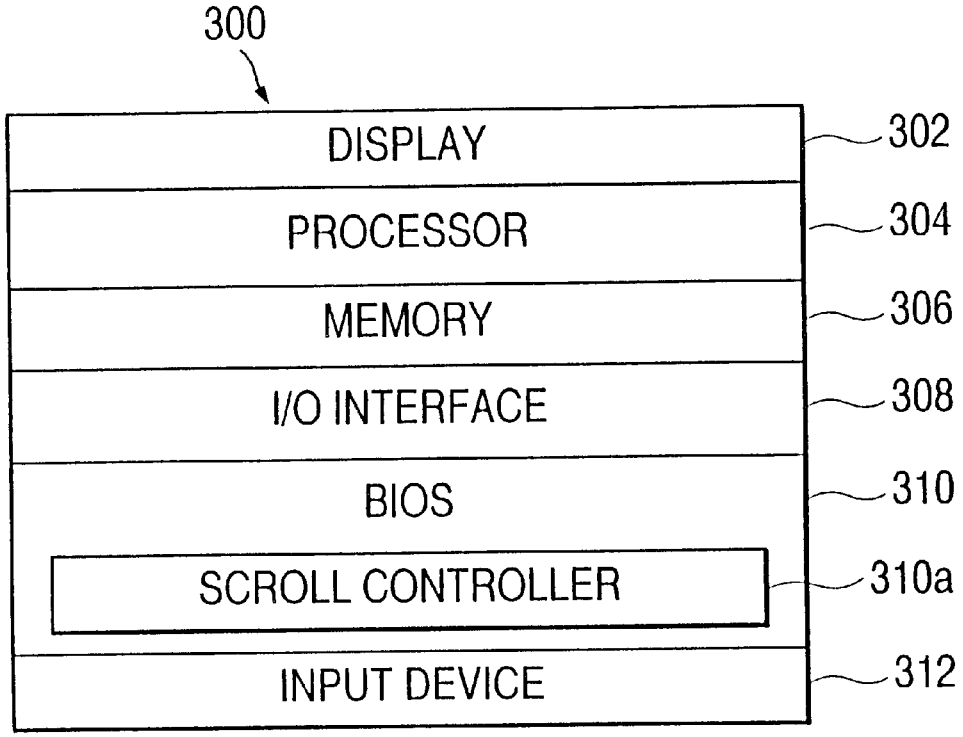
FIG. 17 is a block diagram of a computer including a BIOS ROM which is provided with the present column scrolling capability.

FIG. 17 illustrates a digital computer 300 embodying the present invention. The computer 300 comprises a display 302 such as a cathode ray tube for displaying text to be scrolled, a processor 304, a memory 306 for storing data representing the text to be scrolled in addition to other data, an Input-Output (I/O) interface 308, a BIOS ROM 310, an input device 312 such as a keyboard, and may further comprise other conventional elements such as a printer which are not explicitly illustrated.

The BIOS ROM 310 is a storage in accordance with the present invention which stores program steps that are executed by the processor 304. A subset of the program steps stored in the BIOS ROM 310 constitute a scroll controller 310*a* which performs the method described above.

Various modifications will become possible for those skilled in the art after receiving the teachings of the present disclosure without departing from the scope thereof.

For example, in the method as described above in which more than one column is scrolled at a time, the columns have been contiguous (adjacent to each other). However, the invention is not so limited, and further includes scrolling multiple alternating columns at a time.

We claim:

1. A method for scrolling data which is stored in a computer memory, comprising the steps of:

(a) designating a window including contiguous rows and columns of the data; and (b) vertically scrolling the data in the window by columns, wherein at least one column, but not all of the columns, are scrolled at a time;

wherein step (b) comprises the substeps of:

(b1) determining if a number of columns remaining to be scrolled is less than a first predetermined number, where the first predetermined number is at least two;

(b2) if said number of remaining columns is not less than the first predetermined number, scrolling the first predetermined number of said remaining columns; and (b3) if said number of remaining columns is less than the first predetermined number, scrolling a second predetermined number of said remaining columns, where the second predetermined number is less than the first predetermined number.

2. A method as in claim 1, in which the first predetermined number is two and the second predetermined number is one.

3. A method as in claim 1, in which the first predetermined number is four and the second predetermined number is one.

4. A Basic Input-Output System (BIOS) Read-Only Memory (ROM) which stores a computer program including instructions for scrolling video data that is stored in a computer memory, the instructions performing the steps of:

(a) designating a window including contiguous rows and columns of the data; and (b) vertically scrolling the data in the window by columns wherein at least one column, but not all of the columns, are scrolled at a time;

wherein step (b) comprises the substeps of:

(b1) determining if a number of columns remaining to be scrolled is less than a first predetermined number, where the first predetermined number is at least two;

(b2) if said number of remaining columns is not less than the first predetermined number, scrolling the first predetermined number of said remaining columns; and (b3) if said number of remaining columns is less than the first predetermined number, scrolling a second predetermined number of said remaining columns, where the second predetermined number is less than the first predetermined number.

5. A BIOS ROM as in claim 4, in which the first predetermined number is two and the second predetermined number is one.

6. A BIOS ROM as in claim 4, in which the first predetermined number is four and the second predetermined number is one.

7. A digital computer comprising:

a memory for storing video data, a display for displaying data stored in the memory;

a storage for storing a computer program including instructions for scrolling the video data in the memory; and a processor for executing the instructions in the storage;

the instructions performing the steps of:

(a) designating a window including contiguous rows and columns of the data; and (b) vertically scrolling the data in the window by columns, wherein at least one column, but not all of the columns, are scrolled at a time;

wherein step (b) comprises the substeps of:

(b1) determining if a number of columns remaining to be scrolled is less than a first predetermined number, where the first predetermined number is at least two;

(b2) if said number of remaining columns is not less than the first predetermined number, scrolling the first predetermined number of said remaining columns; and (b3) if said number of remaining columns is less than the first predetermined number, scrolling a second predetermined number of said remaining columns, where the second predetermined number is less than the first predetermined number.

8. A computer as in claim 7, in which the first predetermined number is two and the second predetermined number is one.

9. A computer as in claim 7, in which the first predetermined number is four and the second predetermined number is one.

* * * * *